United States Patent [19]

Matsuhisa et al.

[11] Patent Number: 4,658,887

[45] Date of Patent: Apr. 21, 1987

[54] ROTARY REGENERATOR TYPE CERAMIC HEAT EXCHANGER

[75] Inventors: Tadaaki Matsuhisa, Kasugai; Kiminari Kato, Nagoya, both of Japan

[73] Assignee: NGK Insulators, Ltd., Nagoya, Japan

[21] Appl. No.: 771,153

[22] Filed: Aug. 30, 1985

Related U.S. Application Data

[63] Continuation of Ser. No. 443,695, Nov. 22, 1982, abandoned.

[30] Foreign Application Priority Data

Dec. 23, 1981 [JP] Japan ..... 56-208278

[51] Int. Cl.[4] ..... F28D 19/04

[52] U.S. Cl. ..... 165/8; 165/10

[58] Field of Search ..... 165/9, 10, 8

[56] References Cited

U.S. PATENT DOCUMENTS

| | | | |
|---|---|---|---|
| 3,296,829 | 1/1967 | Williams | 165/8 |
| 3,478,816 | 11/1969 | Helms | 165/10 |
| 3,771,592 | 11/1973 | Sayers | 165/10 |
| 3,885,942 | 5/1975 | Moore | 165/10 |
| 3,939,902 | 2/1976 | Coubrough | 165/8 |

*Primary Examiner*—Albert W. Davis, Jr.

*Attorney, Agent, or Firm*—Parkhurst & Oliff

[57] ABSTRACT

The disclosed ceramic heat exchanger has a stress relief layer disposed in the proximity of joint between a hollow hub and a honeycomb structural body integrally joined to the outer circumference of the hub, the stress relief layer having the difference in thermal expansion of not greater than 0.1% at 800° C. relative to the hub.

19 Claims, 4 Drawing Figures

ROTARY REGENERATOR TYPE CERAMIC HEAT EXCHANGER

This is a continuation of application Ser. No. 443,695 filed Nov. 22, 1982, now abandoned.

BACKGROUND OF THE INVENTION

1. Field of the Invention

This invention relates to a rotary regenerator type ceramic heat exchanger with excellent resistivity against thermal shock, and more particularly to a rotary regenerator type ceramic heat exchanger of center hub support system to be supported at a central portion thereof so as to rotate about a central axis thereof.

2. Description of the Prior Art

In general, a rotary regenerator type ceramic heat exchanger of center hub support system of the prior art uses a well-known structure which comprises a hollow hub with a central shaft hole for receiving a rotary shaft, a cylindrical ceramic honeycomb structural body integrally joined to the outer circumference of the hub, and an annular reinforcing ring secured to the outer circumference of the honeycomb structural body. In a typical arrangement of the prior art, the rotary regenerator type heat exchanger rotates about the central axis thereof in a chamber which is divided into two sections insulated by a sealing material disposed therebetween. One half of the heat exchanger is heated by a hot fluid passing through one of the two sections of the chamber, and the thus heated half is rotated to the other section of the chamber so as to discharge the thus stored heat to a fluid to be heated in said other section.

The ceramic honeycomb structural body of the rotary regenerator type heat exchanger of the prior art has a shortcoming in that it is comparatively easily broken at the joint between the honeycomb structural body and the hub when exposed to thermal shock. More particularly, when the hot fluid passes through the channels of the ceramic honeycomb structural body surrounded by thin ceramic walls, the ceramic honeycomb structural body is heated to a high temperature. On the other hand, the hub at the central portion of the honeycomb structural body is comparatively thick and is not brought in contact with the hot fluid but kept in contact with metallic shaft having a high heat conductivity, so that the hub is kept at a low temperature. Accordingly, a steep temperature gradient is caused between the ceramic honeycomb structural body and the hub during the initial stage of using the heat exchanger, and such steep temperature gradient tends to result in a thermal shock which leads to breakage of the ceramic honeycomb structural body at the joint thereof with the hub.

SUMMARY OF THE INVENTION

Therefore, an object of the present invention is to obviate the above-mentioned shortcoming of the prior art by providing an improved rotary regenerator type ceramic heat exchanger. To this end, the present invention uses a stress relief layer disposed in the joint portion between the ceramic honeycomb structural body and the hub, so as to reduce the steepness of the temperature gradient therebetween. Whereby, the resistivity of the rotary regenerator type ceramic heat exchanger against thermal shock is greatly improved.

A rotary regenerator type ceramic heat exchanger according to the present invention comprises a hollow hub, a ceramic honeycomb structural body having a multiplicity of channels and integrally secured to the outer circumference of the hub, and a stress relief layer disposed on at least one end surface of the honeycomb structural body in the proximity of joint between the hub and the honeycomb structural body where channels of the honeycomb structural body have openings, said stress relief layer having the difference in thermal expansion of not greater than 0.1% at 800° C. relative to the hub.

Another object of the invention is to provide a rotary regenerator type ceramic heat exchanger of the last mentioned type, in which the stress relief layer is disposed on that end surface of the honeycomb structural body which is adapted to receive an incoming hot fluid. In other embodiments, the stress relief layers may also be disposed on opposite end surfaces of the honeycomb structural body.

In a preferred embodiment of the invention, the stress relief layer is formed by stuffing or packing powder or slurry of the same ceramic material as that of the honeycomb structural body into those channels of the honeycomb structural body which have openings in the proximity of joint between the hub and the honeycomb structural body.

In another preferred embodiment of the invention, the stress relief layer is in the form of a flange integrally secured to one end of the hub, which flange is placed in a similarly shaped recess provided on the end surface of the honeycomb structural body in the proximity of joint thereof with the hub. The stress relief layer to be used in the present invention may be in the form of an annular plate adapted to fit in a recess provided on the end surface of the honeycomb structural body in the proximity of the joint thereof with the hub.

BRIEF DESCRIPTION OF THE DRAWINGS

For a better understanding of the invention, reference is made to the accompanying drawings, in which.

Throughout different views of the drawings, 1 is a honeycomb structural body, 2 is a channel, 3 is a shaft hole, 4 is a hub, 5 and 5' are end surfaces, 6 is a stress relief layer, 7 is a recess, 8 is a flange, and 9 is an annular plate.

DESCRIPTION OF THE PREFERRED EMBODIMENTS

Figure 1:
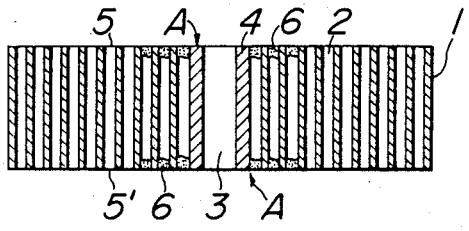
FIG. 1 is a schematic sectional view of a rotary regenerator type ceramic heat exchanger according to the present invention.

Referring to FIG. 1 illustrating a preferred embodiment of the invention, a ceramic honeycomb structural body 1 has a multiplicity of parallel channels 2. The cross-sectional shape of the individual channels 2 can be suitably selected; for instance, the channels 2 may be polygonal such as triangular, rectangular, or hexagonal, or circular. The honeycomb structural body 1 is made of a ceramic material with a low coefficient of thermal expansion, such as cordierite, mullite, alumina, $\beta$-spodumene, $MgO$-$Al_2O_3$-$TiO_2$ system ceramic material, $MgO-Al_2O_3-TiO_2-Fe_2O_3$ system ceramic material, or $MgO-Al_2O_3-TiO_2-SiO_2-Fe_2O_3$ system ceramic material. The honeycomb structural body 1 can be made by extruding process, corrugating process which is shown in Hollenbach, U.S. Pat. No. 3,112,184, or embossing process. A shaft hole 3 for receiving a rotary shaft (not shown) is bored through a hub 4 as a central hollow space thereof, and the hub 4 is integrally joined to the central portion of the honeycomb structural body 1. The channels 2 of the honeycomb structural body 1 open at opposite end surfaces 5 and 5' of the body 1.

In the embodiment of FIG. 1, the opposite end surfaces 5 and 5' of the honeycomb structural body 1 have stress relief layers 6 disposed in the proximity of joint A between the hub 4 and the body 1. The material of the stress relief layer 6 has the difference in thermal expansion of not greater than 0.1% at 800° C. relative to the hub 4. Preferably, the material of the stress relief layer 6 is the same as the material of the hub 4.

One of the two stress relief layer 6 of FIG. 1 can be disposed with in the invention. Thus, only one stress relief layer 6 on one end surface 5 or 5' of the honeycomb structural body 1 will do, provided that the stress relief layer 6 is disposed on the end surface of the body 1 in the proximmity of joint A between the hub 4 and the body 1.

In operation, the stress relief layer 6 blocks those channels 2 of the ceramic honeycomb structural body 1 which are in the proximity of joint A between the hub 4 and the body 1, and neither hot fluid nor cold fluid to be heated flows through the thus blocked channels 2. Besides, the heat conductivity of the blocked channels 2 is smaller than that of the hub 4, for instance about one sixth of the latter. Whereby, the temperature gradient in the proximity of joint A between the hub 4 and the body 1 can be kept very low, and the resistivity of the rotary regenerator type ceramic heat exchanger against thermal shock is greatly improved.

Figure 2:
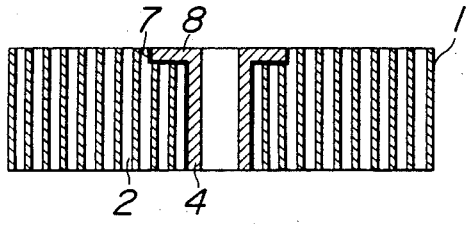
FIG. 2 is a schematic sectional view of an embodiment of the invention having a stress relief layer formed by a flange integral with a hub.
Figure 3:
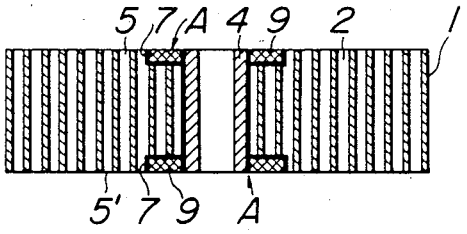
FIG. 3 is a schematic sectional view of another embodiment of the invention having a stress relief layer in the form of an annular plate.

Various methods are available for producing the stress relief layer 6. One example is to fill powder or slurry of the same material as that of the ceramic honeycomb structural body 1 in those channels 2 of the body 1 which have openings in the proximity of joint A between the hub 4 and the body 1, and to solidify and fix the thus filled material by firing. In the embodiment of FIG. 2, a recess 7 if formed along inner periphery of that end surface of the honeycomb structural body 1 which is adapted to receive a hot fluid, and the stress relief layer is made in the form of a flange 8 integral with the hub 4, which flange 8 is fitted in and secured to the recess 7 of the body 1. FIG. 3 shows another embodiment, in which recesses 7 are formed along the inner peripheries of opposite end surfaces 5 and 5' of the honeycomb structural body 1 where the channels 2 have openings, and annular plates 9 are fitted and secured to the recesses 7, so as to form the stress relief layers in the proximity of joint A between the hub 4 and the body 1.

In short, the function of the stress relief layer 6 is to prevent the hot fluid and the cold fluid to be heated from entering into those channels 2 of the honeycomb structural body 1. It is also important that stress relief layer 6 has the difference in thermal expansion of not greater than 0.1% at 800° C. relative to the hub 4. The thickness of the stress relief layer 6 depends on various conditions for use such as the shape and size of the channels 2 of the honeycomb structural body 1 and the length of the hub 4, but the thickness of less than one tenth of the length of the hub 4 is generally sufficient for the stress relief layer 6. The stress relief layer 6 can be formed when a fired hub 4 and a fired honeycomb structural body 1 are joined, or when green bodies of the hub 4 and the body 1 are joined and then fired therewith. The preferable material of the stress relief layer 6 has substantially the same mineral composition as that of the hub 4, and if the same mineral composition is not used, it is important that the material of the stress relief layer 6 is such that the difference in thermal expansion at 800° C. between the stress relief layer 6 and the hub 4 is not greater than 0.1% thereof. If the abovementioned difference in thermal expansion at 800° C. exceeds 0.1% thereof, the resistivity against thermal shock at the joint between the hub 4 and the stress relief layer 6 becomes insufficiently low.

The invention will be described in further detail now by referring to examples.

EXAMPLE 1

A number of sector segments of the honeycomb structural body 1 with channels 2 of triangular cross section were prepared by extruding cordierite body, while hubs 4 with thick walls were prepared by pressing. The sector segments of the honeycomb structural body 1 and the hubs 4 thus prepared were fired in a tunnel kiln at 1,400° C. for five hours, and then machined into desired shapes and dimensions. Ceramic paste to be converted into mineral cordierite upon firing was applied between the adjacent sector segments of the honeycomb structural body 1 and between the hub 4 and the body 1, so as to joint the segments with each other and to join the hub 4 to the body 1. The abovementioned ceramic paste was filled in those channels 2 of the honeycomb-structural body 1 at the opposite end surfaces 5, 5' thereof which had openings in the proximity of joint A between the hub 4 and the body 1.

Thereafter, the thus assembled ceramic article was dried and fired again at 1,400° C. for five hours, so as to produce a rotary regenerator type ceramic heat exchanger of the invention having the stress relief layers 6 integrally formed at opposite end surfaces 5, 5' of the honeycomb structural body 1 thereof. The difference in thermal expansion between the hub 4 and the stress relief layer 6 of the heat exchanger thus produced proved to be 0.005% thereof.

For reference, a conventional heat exchanger without the stress relief layer was prepared by using the same material as that of the above-mentioned heat exchanger of the invention.

Thermal shock tests were carried out on both the heat exchanger of the present invention and the reference heat exchanger without any stress relief layer, by keeping the heat exchangers at a certain temperature in an electric furnace for 30 minutes and cooling the heat exchangers at room temperature for 30 minutes after removing them from the electric furnace to the open space of a testing room. The heating temperature of the thermal shock tests started from 500° C., and when the cooling at room temperature did not cause any irregularities in the heat exchangers, the heating temperature in the electric furnace was increased in step at an interval of 50° C. until cracks were caused in the heat exchangers, so that the temperatures at which the cracks were caused in different exchangers were compared.

The result of the thermal shock tests proved that, in the case of the heat exchanger of the prior art, cracks were caused between the hub 4 and the honeycomb structural body 1 at a temperature difference of 650° C. and the joint between the hub 4 and the body 1 was completely broken at a temperature difference of 800° C. On the other hand, in the case of the heat exchanger of the present invention, no cracks were formed at a temperature difference of 850° C., and cracks were formed along the outer circumference of the heat exchanger only when the temperature difference increased to 900° C., but no cracks were detected between the hub 4 and the body 1 at this temperature difference, and minor cracks were noticed between the hub 4 and the body 1 only when the temperature difference reached 950° C.

EXAMPLE 2

Figure 4:
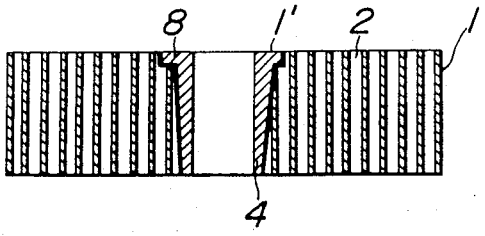
FIG. 4 is a schematic sectional view of another embodiment of the invention having a hub with a tapered sidewall.

A monolithic honeycomb structural body 1 of mullite with a thickness of 70 mm and a diameter of 150 mm having channels 2 of rectangular cross sections was prepared by embossing process, and a hub 4 having a flange 8 at one end thereof and a tapered outer circumferential wall was prepared by pressing a body of the same material as that of the body 1. To render sufficient mechanical strength, the body 1 and the hub 4 were calcined at 1,000° C. for one hour, and the calcined hub 4 and the body 1 were machined so that they can be assembled snugly as shown in FIG. 4. A slurry which contained ingredients to be converted into mullite upon firing was applied to the joining surfaces of the hub 4 and the body 1. After the hub 4 and the body 1 were joined by applying pressure thereto, the thus joined hub 4 and the body 1 were dried and fired at 1,370° C. for three hours. Whereby, a heat exchanger according to the present invention having a stress relief layer on only one end surface thereof was produced.

The difference in thermal expansion at 800°l C. between the hub 4 and the stress relief layer formed of the flange 8 of the heat exchanger of this example was 0.02% thereof. The same thermal shock tests as those of Example 1 were carried out on the heat exchanger of this example by quick heating followed by quick cooling. The result of the thermal shock tests proved that no cracks were found at the temperature difference of 400° C. Cracks were formed in the honeycomb structural body 1 only when the temperature difference increased to 450° C., but even at this temperature difference no cracks were found at the joint between the hub 4 and the body 1.

As described in the foregoing, a rotary regenerator type ceramic heat exchanger according to the present invention has a stress relief layer disposed in the proximity of joint between a hub and a honeycomb structural body thereof on at least one end surface of the body where channels thereof have openings, the stress relief layer having the difference in thermal expansion of not greater than 0.1% at 800° C. relative to the hub, whereby excellent resistivity against thermal shock is rendered to the heat exchanger. Accordingly, the heat exchanger of the invention can be used advantageously in various fields of industry; for instance as the rotary regenerator type heat exchanger attached to a gas turbine or a Sterling engine for improving the fuel saving effects thereof.

Although the invention has been described with a certain degree of particularly, it is understood that the present disclosure has been made only by way of example and numerous changes in details of construction and combination and arrangement of parts may be resorted to without departing from the scope of the invention as hereinafter claimed.

What is claimed is:

1. A rotary regenerator type ceramic heat exchanger, comprising a hub having a hollow central portion, a ceramic honeycomb structural body having a plurality of longitudinally extending channels, said honeycomb structural body being integrally secured to an outer circumference of the hub along its entire longitudinal length thereof, thereby forming a joint portion between the hub and the ceramic honeycomb structural body, at least one channel blocking layer formed radially outward from said joint portion, said at least one channel blocking layer extending into said plurality of longitudinally extending channels not more than one tenth the length of the longitudinal hub, said at least one channel blocking layer being located at at least one longitudinal end surface of said ceramic body, thereby forming at least one stress relief layer, said at least one channel blocking layer having a difference in thermal expansion of not greater than 0.1% at 800° C. relative to the hub.

2. The heat exchanger of claim 1, wherein said channel blocking layer is located at an end surface of the honeycomb structural body which receives an incoming hot fluid.

3. The heat exchanger of claim 1, wherein said channel blocking layer is formed from the same material as the ceramic honeycomb structural body, said material being packed into the longitudinally extending channels.

4. The heat exchanger of claim 1, wherein said channel blocking layer is formed from at least one flange which is integrally secured to at least one end of said hub and said body has a recess formed on at least one end surface thereof, so at to receive said at least one flange of the hub.

5. The heat exchanger of claim 1, wherein said channel blocking layer is formed from at least one annular plate fitted in a recess formed at on least one end surface of said body so as to receive said annular plate.

6. The heat exchanger of claim 1, wherein said channel blocking layer is made from a powder material of the body, which is packed into said longitudinally extending channels.

7. The heat exchanger of claim 1, wherein said channel blocking layer is made from a solidified slurry of the material of the body, which is packed into said longitudinally extending channels.

8. The heat exchanger of claim 3, wherein the material is packed into both end surfaces of the longitudinally extending channels.

9. The heat exchanger of claim 4, wherein a flange is integrally secured to both ends of said hub.

10. The heat exchanger of claim 5, wherein an annular plate is fitted on both end surfaces of said body.

11. The heat exchanger of claim 6, wherein the powder material is packed into both end surfaces of the longitudinally extending channels.

12. The heat exchanger of claim 7, wherein the solidified slurry is packed into both end surfaces of the longitudinally extending channels.

13. The heat exchanger of claim 2, wherein said channel blocking layer is formed from the same material as the ceramic honeycomb structural body, said material being packed into the longitudinally extending channels.

14. The heat exchanger of claim 4, wherein the flange is formed from the same material as the ceramic honeycomb structural body.

15. The heat exchanger of claim 4, wherein the flange is formed from the same material as the hub.

16. The heat exchanger of claim 5, wherein the annular plate is formed from the same material as the ceramic honeycomb structural body.

17. The heat exchanger of claim 5, wherein the annular plate is formed from the same material as the hub.

18. The heat exchanger of claim 6, wherein the powder material is formed from the same material as the ceramic structural body.

19. The heat exchanger of claim 7, wherein the solidified slurry is formed from the same material as the ceramic honeycomb structural body.

* * * * *